US005264159A

United States Patent [19]

Ikeda et al.

[11] Patent Number: 5,264,159

[45] Date of Patent: Nov. 23, 1993

[54] PROCESS FOR TREATING SALT WASTE GENERATED IN DRY REPROCESSING OF SPENT METALLIC NUCLEAR FUEL

[75] Inventors: Yasuhisa Ikeda; Yoshiyuki Yasuike; Makoto Yamaguchi, all of Kashiwa; Hiroaki Kobayashi, Nakaminato; Hiroshi Igarashi, Katsuta, all of Japan

[73] Assignee: Doryokuro Kakunenryo Kaihatsu Jigyodan, Tokyo, Japan

[21] Appl. No.: 945,397

[22] Filed: Sep. 16, 1992

[30] Foreign Application Priority Data

Sep. 27, 1991 [JP] Japan ..... 3-277076

[51] Int. Cl.[5] ..... G21F 9/04

[52] U.S. Cl. ..... 252/629; 252/626; 252/631; 252/633; 588/252

[58] Field of Search ..... 252/627, 629, 631, 626; 423/251, 257, 252, 260, 261; 588/201, 252

[56] References Cited

U.S. PATENT DOCUMENTS

| | | | |
|---|---|---|---|
| 4,459,153 | 7/1984 | Mullins et al. | 75/397 |
| 4,504,317 | 3/1985 | Smeltzer et al. | 106/90 |
| 4,800,042 | 1/1989 | Kurumada et al. | 252/628 |
| 4,814,046 | 3/1989 | Johnson et al. | 204/1.5 |
| 5,041,193 | 8/1991 | Grantham | 204/1.5 |
| 5,096,545 | 3/1992 | Ackerman | 204/1.5 |
| 5,143,653 | 9/1992 | Magnin et al. | 252/628 |

*Primary Examiner*—Donald P. Walsh
*Assistant Examiner*—Ngochan T. Mai
*Attorney, Agent, or Firm*—Wenderoth, Lind & Ponack

[57] ABSTRACT

A salt waste composed mainly of chlorides, which is generated from the step of a molten salt electrolytic purification in dry reprocessing of a spent metallic nuclear fuel, is reacted with boric acid at high temperature to convert the chlorides in the salt waste into oxides. The resulting oxides of the salt waste are easily vitrifiable, and a vitrification product is obtained by adding a vitrifying additive to the oxides, heat-melting the mixture to form a molten mixture and cooling the molten mixture.

7 Claims, 8 Drawing Sheets

PROCESS FOR TREATING SALT WASTE GENERATED IN DRY REPROCESSING OF SPENT METALLIC NUCLEAR FUEL

BACKGROUND OF THE INVENTION

The present invention relates to a process for treating a salt waste generated from the step of a molten salt electrolytic purification in dry reprocessing of a spent metallic nuclear fuel (hereinafter referred to merely as the "metallic fuel" in some cases).

The metallic fuel is one of the novel fuels for a fast breeder reactor (FBR) which has attracted attention as a fuel capable of essentially solving the problem of nuclear fuel resources.

Examples of such a metallic fuel include a ternary alloy fuel, U-Pu-Zr, and a dry reprocessing process wherein the principle of electrolytic refining is applied in order to reprocess the spent fuel (see M. Tokiwai, Y. Tanaka, Z. Yamamoto, T. Kuroki, T. Nishimura and K. Yokoo: Nuclear Engineering, Vol. 33, p. 66 (1987); M. Tokiwai: Nuclear Engineering, Vol. 34, p. 46 (1988); and L. Burris, R. K. Steunenberg and W. E. Miller: Annual AICHE Meeting, Miami, Fla., Nov. 2–7 (1986)).

Since the metallic fuel is dry reprocessed as described above, wastes peculiar to the dry reprocessing, such as molten metals and salts, are generated unlike in the wet reprocessing and various proposals have been made on the processing and disposal of the wasters.

Regarding a salt waste among these wastes, a cementation process has been proposed by Argonne National Laboratory (ANL) in U.S.A. This process comprises bringing the salt waste into contact with a liquid metal (Cd-Li) to extract transuranic elements (TRU) into cadmium, conducting group partition, mixing the partitioned material with a cement matrix material and water, injecting the mixture in a liquid state into a metallic container, and solidifying the mixture.

The cementation process, however, has problems that the leaching resistance is low and hydrogen and chlorine are generated under radiation exposure, so that the development of a method of stably and safely storing long-lived nuclides for a long period of time is desired in the art.

SUMMARY OF THE INVENTION

An object of the present invention is to provide a process for treating a salt waste generated in dry reprocessing of a spent metallic nuclear fuel, wherein the salt waste generated from the step of electrolytic purification in the dry reprocessing is converted into an easily vitrifiable oxide form which can be disposed of as a vitrification product capable of stably existing for a long period of time.

According to the present invention, the above-described object can be accomplished by a process for treating a salt waste composed mainly of chlorides generated from the step of a molten salt electrolytic purification in dry reprocessing of a spent metallic nuclear fuel, which process comprising reacting the salt waste with boric acid to convert the chlorides in the salt waste into oxides.

The temperature of the reaction is preferably 800° to 1000° C. The amount of boric acid to be reacted is preferably 3 to 6 times the stoichiometric amount.

In a preferred embodiment of the present invention, the process further comprises the step of adding a vitrifying additive to the resulting oxides of the salt waste, heat-melting the mixtures to form a molten mixture, and cooling the molten mixture to obtain a vitrification product.

It may safely be said that almost the whole of the salt waste generated in the dry reprocessing of a spent metallic nuclear fuel is in the form of chloride. Therefore, it is very difficult to directly vitrify such a salt waste composed mainly of chlorides by using a vitrification process employed as a means for treating a high-level liquid waste generated in the reprocessing of a spent nuclear fuel used in a light water reactor (LWR). For example, although studies are in progress on various halide glasses (glasses of halogenides) in the field of special glasses, it is difficult to vitrify the halide, and the production of halide glasses should be conducted within a glove box filled with dried nitrogen or helium. Further, in general, the water resistance of these halide glasses is so low that they are unsuitable as a solidification product of radioactive wastes.

By contrast, in the present invention, the chlorides in the salt waste are converted into oxides by reacting the salt waste with boric acid (orthoboric acid, boric acid anhydride, etc.) at high temperature to give the oxides, which facilitate the vitrification. In this case, the conversion of the chlorides into the oxides occurs more easily than in a high-temperature hydrolysis process wherein a chloride is reacted with water vapor at high temperature to form an oxide.

Thus, since the chlorides are vitrified after the conversion thereof into the easily vitrifiable oxides, it is possible to dispose of the salt waste as a vitrification product which can stably exist for a long period of time.

DETAILED DESCRIPTION OF THE INVENTION

Figure 1:
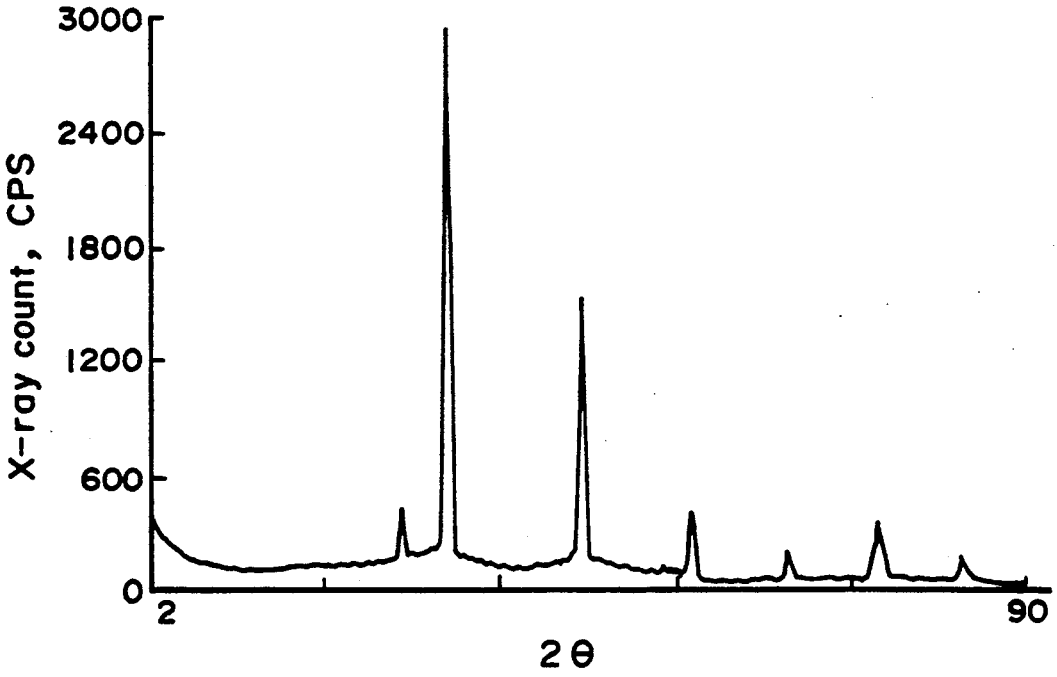
FIGS. 1 and 2 are graphs showing the results of X-ray diffractometry (XRD) and the results of infrared (IR) spectroscopy, respectively, of a product of the reaction of NaCl with $H_3BO_3$ according to the present invention.

In the present invention, a salt waste generated in dry processing of a spent metallic fuel such as, for example, a ternary alloy fuel, U-Pu-Zr, can be treated. The step of electrolytic purification in the dry reprocessing comprises molten salt electrolysis of LiCl-KCl eutectic salt wherein molten cadmium is used as an anode.

Most of the salt waste generated from the step of the electrolytic purification is chlorides including LiCl-KCl used as a bath salt. Specifically, when the above-described ternary alloy fuel is dry reprocessed, examples of the salt waste produced include chlorides of actinoids, that is, $UCl_3$, $PuCl_3$, $NpCl_3$, $AmCl_3$ and $CmCl_3$; chlorides of alkali metals, that is, CsCl, RbCl and NaCl; chlorides of alkaline earth metals, that is, $BaCl_2$, $MgCl_2$ and $SrCl_2$; and chlorides of rare earth elements, that is, $LaCl_3$, $PrCl_3$, $CeCl_3$, $NdCl_3$, $SmCl_3$, $PmCl_3$, $YCl_3$, $TbCl_3$, $GdCl_3$ and $EuCl_3$. All of these chlorides, except for the bath salt, originate in fission products (FP) and hence are radioactive.

The salt waste to be treated in the present invention may be one directly obtained from the step of the electrolytic purification, or one obtained by subjecting the resultant salt waste to FP separation by metallic reduction, molten salt electrolysis, or the like.

Since all of the salt wastes contain transuranic elements (TRU) having a long half-life ($T_{\frac{1}{2}}$), that is, Pu, Np, Am and Cm, it should be disposed of as a stable solidification product, so that the effect of the present invention can be exerted.

In the present invention, the salt waste is converted into an oxide by reacting the salt waste with boric acid. For example, a monovalent metal, such as an alkali metal, reacts with orthoboric acid according to the following formula (1) or with boric acid anhydride according to the following formula (1'), and these reactions are utilized in the present invention:

$$6MCl+2H_3BO_3 \rightarrow 3M_2O+B_2O_3+6HCl\uparrow \quad (1)$$

$$6MCl+B_2O_3 \rightarrow 6MO_{0.5}+2BCl_3\uparrow \quad (1')$$

wherein M is K, Na, Li or the like. Also in the case of polyvalent metals such as divalent metals, e.g. Ba and Sr and trivalent metals, e.g. Ce, the reaction proceeds similarly according to the formula (1) or (1').

Specifically, a salt waste is converted into an oxide by mixing the salt waste with a stoichiometrically necessary amount of boric acid, raising the temperature from room temperature to 800° to 1000° C. over a period of about 1 to 2 hours, and heating the mixture at that temperature in the air for 30 to 60 minutes to allow a reaction to proceed. In general, the amount of boric acid to be reacted may be 3 to 6 times, preferably 5 to 6 times, the stoichiometric amount.

The chloride is thought to be converted into an oxide at a degree of conversion of 80 to 100% by the reaction described above. When the chloride remains unreacted, there occur unfavorable phenomena such as gas generation during or after solidification and a deterioration of the stability of a solidification product. However, scarcely any problem occurs in the above-described degree of conversion. In addition, the stability of the solidification product is remarkably improved as compared with the case where the chloride is solidified as such.

The oxide produced by the above-described reaction can be obtained in various forms although the form slightly varies depending upon the reaction conditions, etc. Specifically, the chloride gives a noncrystalline borate glass in the case of Na, K, Cs, etc., and optionally Li depending upon the conditions, a crystalline boric acid compound in the case of Li, Ba, Sr, etc., and an oxide in the case of Ce, etc. Such products can be confirmed by X-ray diffractometry (XRD), infrared (IR) absorption spectrometry, or the like.

In the preferred embodiment of the present invention, the thus produced oxide is then vitrified. In this case, since the chloride is in a state converted into an oxide, the vitrification can be easily conducted. The oxide is vitrified by mixing a vitrifying additive with the powdery oxide, heat-melting the mixture at high temperature and cooling the molten mixture to form a glass. The melt vitrification provides a glass having a good stability. Examples of the vitrifying additive include $SiO_2$, $B_2O_3$, $Al_2O_3$, $Li_2O$, $Na_2O$, $K_2O$, CaO and ZnO. If necessary, BaO may be used in addition to these additives. Further, it is also possible to select $SiO_2$, $B_2O_3$ and $Na_2O$ from the above-described oxide additives and MgO and TiO as further additives and further properly select other oxide additives. The glass is preferably a borosilicate glass from the viewpoint of the radiation resistance, workability, handling properties, water resistance, etc.

Among the above-described oxide additives, those which are converted into a borate glass through a reaction with boric acid may be added in the mixture of the salt waste and boric acid to melt the oxide additive during the reaction of the salt waste with boric acid. Thus, a vitrified substance can be formed without conducting subsequent vitrification step, and the resulting vitrified substance can be disposed of as a vitrification product. In this case, the amount of the boric acid to be reacted is preferably 3 to 6 times the stoichiometric amount.

In the present invention, the FP content in the vitrification product may be 20% by weight or less, particularly 15 to 20% by weight. When the content is in this range, the stability of the vitrification product can be improved.

When a vitrification product is formed according to the present invention, the vitrification product is superior in the chemical resistance to the solidification product formed by the conventional cementation process employed in Argonne National Laboratory and has superior heat and mechanical stabilities. Also the water resistance is superior.

The present invention will now be described in more detail with reference to the following Examples and Experimental Examples.

EXPERIMENTAL EXAMPLE 1

NaCl, KCl, LiCl and CsCl were used as a monovalent metal chloride, $BaCl_2.2H_2O$ and $SrCl_2$ were used as a divalent metal chloride and $CeCl_3.6H_2O$ was used as a typical chloride of lanthanoids and actinoids. Each of these chlorides was mixed with boric acid in an amount 3 times as large as the stoichiometric amount to prepare a sample. Specifically, the composition of the mixture in a molar ratio was adjusted as follows:

$$MCl\ (M=Na, K, Li, Cs):H_3BO_3=1:1$$

$MCl_2$ (M=Ba, Sr):$H_3BO_3$=1:2

$MCl_3$ (M=Ce):$H_3BO_3$=1:3

About 3 g of each sample was accurately weighed into a platinum crucible and heated in an electric oven for melting. In the heat-melting, the sample was heated from room temperature to 1000° C. over a period of 2 hours and maintained at that temperature for one hour, and the crucible was taken out of the oven and rapidly cooled with water. After cooling, the crucible was dried in a desiccator to constant weight and the weight was measured. Then, the degree of conversion was determined from a change in the weight before and after the heating and the theoretical amount of weight reduction determined from the formula (1). In order to identify the product after heat-melting, XRD and IR spectroscopy were conducted with RAD-C system manufactured by Rigaku Corporation and FT-IR FTS-40 manufactured by Bio-Rad Laboratories, respectively. The IR spectroscopy was conducted by the diffuse reflectance measuring method.

Each mixture system will now be described. Since the amount of boric acid is excess over the stoichiometric amount in the reaction formula (1), it is conceivable that boric acid not only reacts with the chloride but also brings about thermal decomposition. Therefore, the thermal decomposition of boric acid as well was studied.

a. Thermal decomposition of boric acid

When $H_3BO_3$ alone was heated under the condition as described above, a transparent, vitreous product was obtained. Thus, it is conceivable that thermal decomposition occurs substantially according to the following formula:

$$2H_2BO_3 \rightarrow B_2O_3 + 3H_2O \uparrow \quad (2)$$

In fact, when the degree of conversion was calculated through a comparison of a change in the weight before and after heating with the theoretical amount of weight reduction on the assumption that a reaction represented by the formula (2) alone occurs, it was suggested that $H_3BO_3$ was converted into $B_2O_3$ at a high degree of conversion. Thus, the degree of conversion was calculated on the assumption that $H_3BO_3$ is completely decomposed into $B_2O_3$ and $H_2O$ in the following mixture system.

b. Mixture system comprising NaCl and $H_3BO_3$

The reactions which are though to occur when the system is heated are represented by the following formulas:

$$6NaCl + 2H_3BO_3 \rightarrow 3Na_2O + B_2O_3 + 6HCl \uparrow \quad (3)$$

$$2H_3BO_3 \rightarrow B_2O_3 + 3H_2O \uparrow \quad (4)$$

When a sample prepared by mixing NaCl with $H_3BO_3$ in a molar ratio of 1:1 was heated, a transparent, vitreous product was obtained. The degree of conversion was 83.4% as calculated from a change in the weight before and after the heating.

Figure 2:
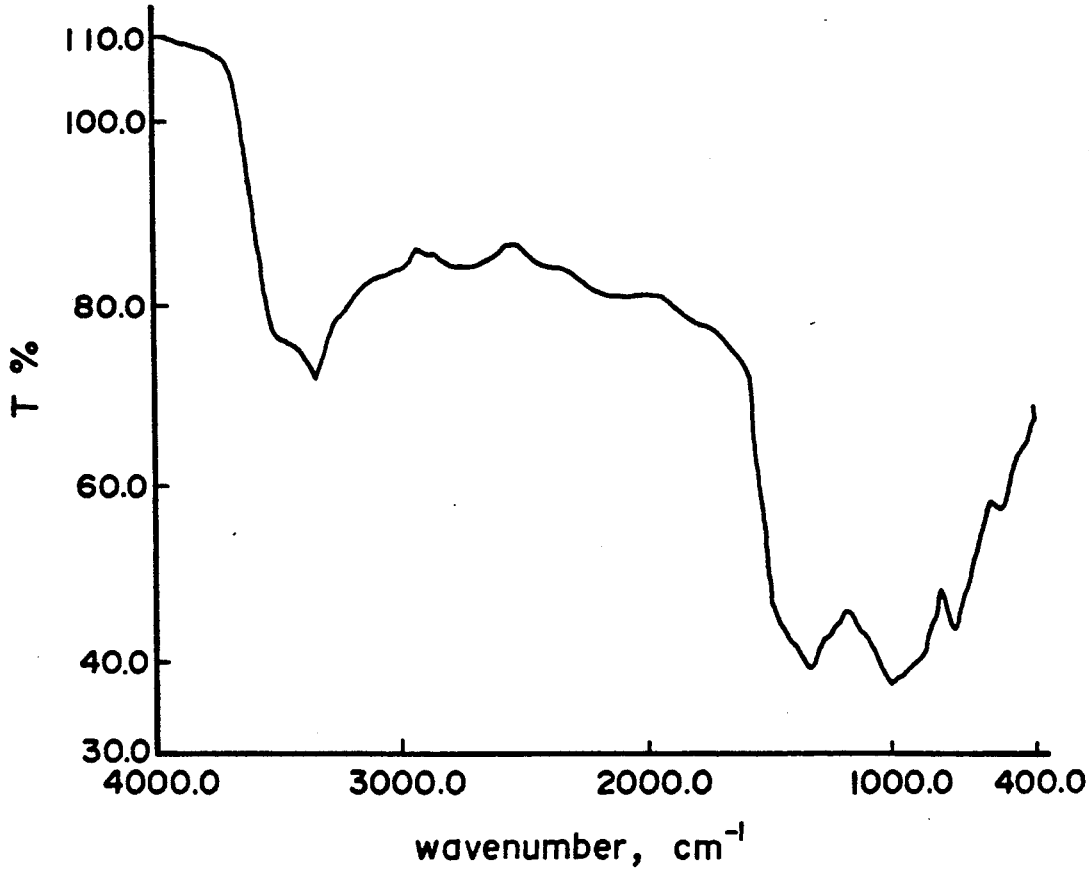

The results of XRD of this product are shown in FIG. 1, and the results of IR spectroscopy are shown in FIG. 2. From these results, this product is thought to be a borate glass composed mainly of $Na_2O.2B_2O_3$. Further, a comparison of this product with a known alkali borate crystal suggests that the major structural unit is a diborate group (see S. Sakka: Garasu-Hishoushitsu no Kagaku, pp. 183–187 (1983) published by Uchida Rokakuho Publishing Co., Ltd.).

c. Mixture system comprising KCl and $H_3BO_3$

In this system, the following reactions are thought to occur:

$$6KCl + 2H_3BO_3 \rightarrow 3K_2O + B_2O_3 + 6HCl \uparrow \quad (5)$$

$$2H_3BO_3 \rightarrow B_2O_3 + 3H_2O \uparrow \quad (6)$$

When a mixture comprising KCl and $H_3BO_3$ in a molar ratio of 1:1 was heated, a transparent, vitreous product was obtained. Further, a white powder, supposedly KCl, was also present. As with the above-described system, the degree of conversion was calculated from a change in the weight before and after the heating and found to be 87%.

Figure 3:
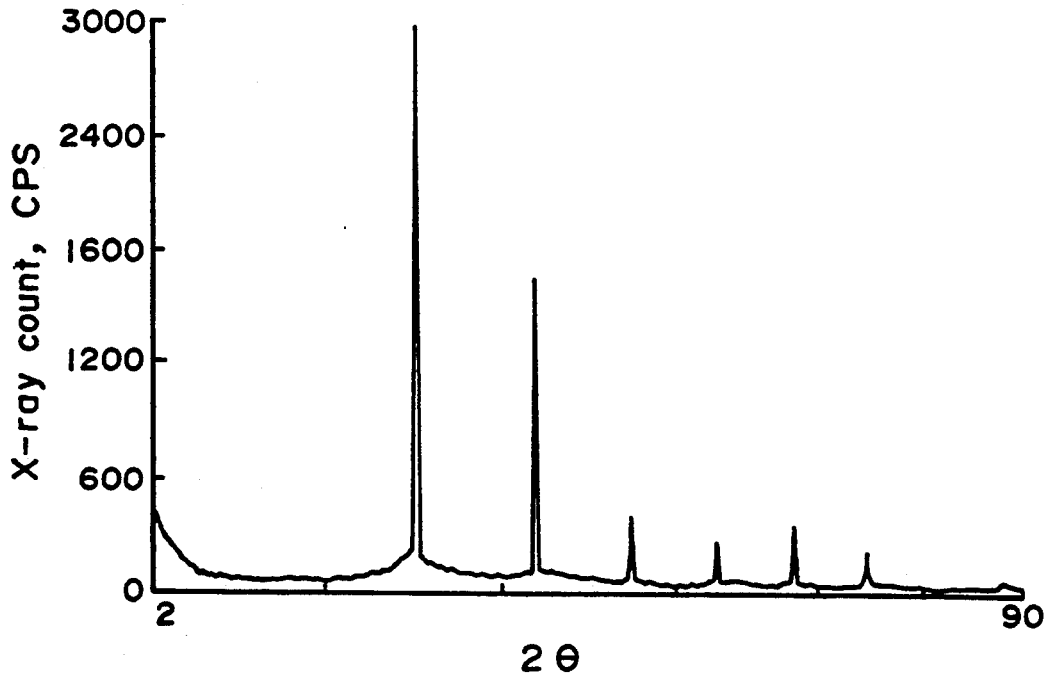
FIGS. 3 and 4 are graphs showing the results of XRD and the results of IR spectroscopy, respectively, of a product of the reaction of KCl with $H_3BO_3$ according to the present invention.
Figure 4:
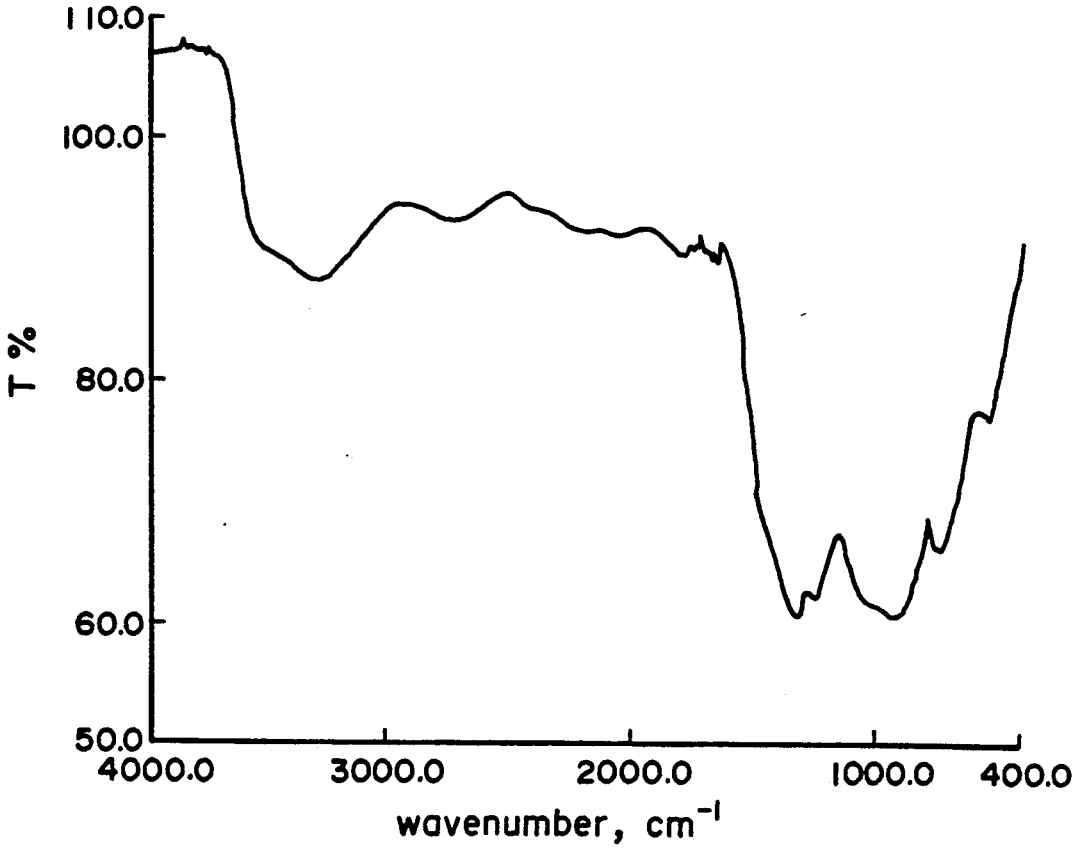

The results of XRD of this vitreous product are shown in FIG. 3, and the results of IR spectroscopy are shown in FIG. 4. From these results, this product is thought to be a glass composed of $K_2O.2B_2O_3$. Further, in this product as well, the major structural unit is thought to be a diborate group (see S. Sakka: Garasu-Hishoushitsu no Kagaku, ibid.).

d. Mixture system comprising LiCl and $H_3BO_3$

In this system, the following reactions are thought to occur:

$$6LiCl + 2H_3BO_3 \rightarrow Li_2O + B_2O_3 + 6HCl \uparrow \quad (7)$$

$$2H_3BO_3 \rightarrow B_2O_3 + 3H_2O \uparrow \quad (8)$$

When a mixture comprising LiCl and $H_3BO_3$ in a molar ratio of 1:1 was heated, a white product was obtained. The degree of conversion was 101% as calculated from a change in the weight before and after the heating, suggesting that LiCl was completely converted into an oxide.

Figure 5:
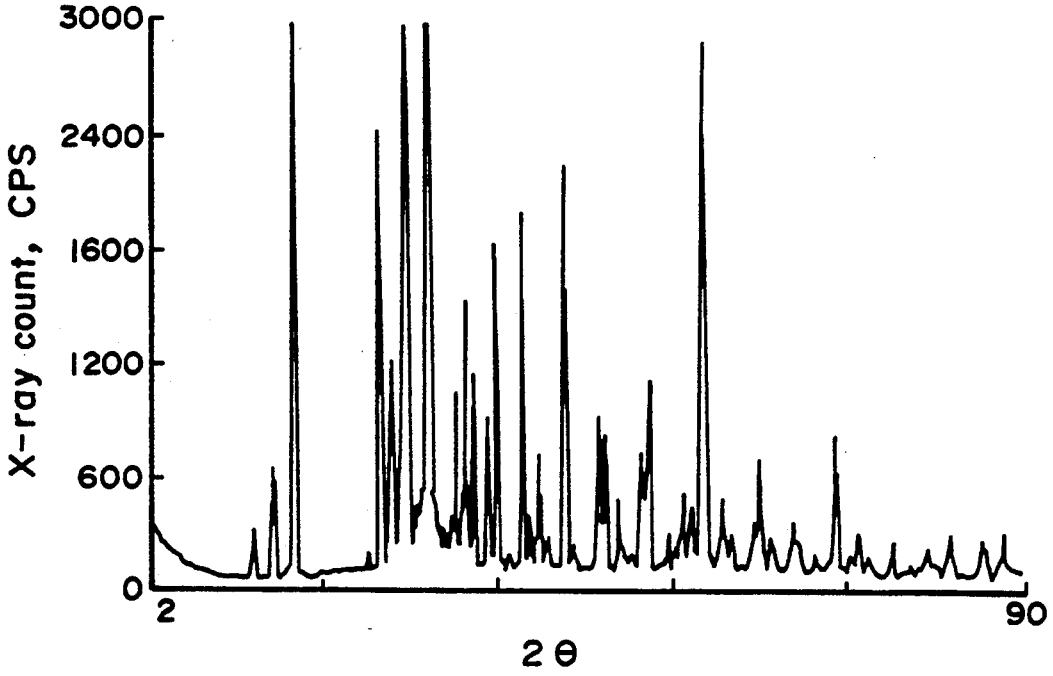
FIGS. 5 and 6 are graphs showing the results of XRD and the results of IR spectroscopy, respectively, of a product of the reaction of LiCl with $H_3BO_3$ according to the present invention.
Figure 6:
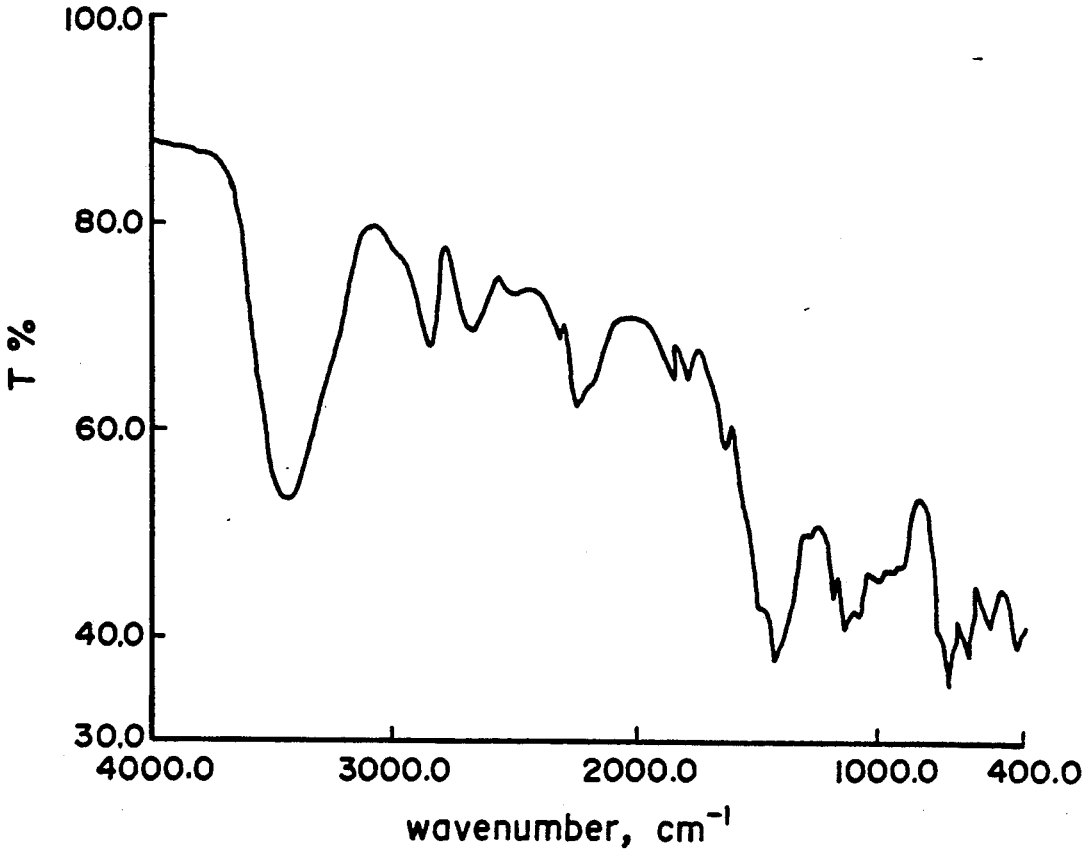

The results of XRD of this product are shown in FIG. 5, and the results of IR spectroscopy are shown in FIG. 6. From these results, this product was identified with essentially crystalline $Li_2B_2O_4$.

e. Mixture system comprising CsCl and $H_3BO_3$

In this system, the following reactions are thought to occur:

$$6CsCl + 2H_3BO_3 \rightarrow Cs_2O + B_2O_3 + 6HCl \uparrow \quad (9)$$

$$2H_3BO_3 \rightarrow B_2O_3 + 3H_2O \uparrow \quad (10)$$

When a mixture comprising CsCl and $H_3BO_3$ in a molar ratio of 1:1 was heated, a transparent, vitreous product was obtained. Further, a white powder, supposedly CsCl, was also present. The degree of conversion was 220% as calculated from a change in the weight before and after the heating. Such a conversion presumably results from the thermal decomposition of CsCl according to the following formula:

$$4CsCl + O_2 \rightarrow 2Cs_2O + 2Cl_2 \uparrow \quad (11)$$

Figure 7:
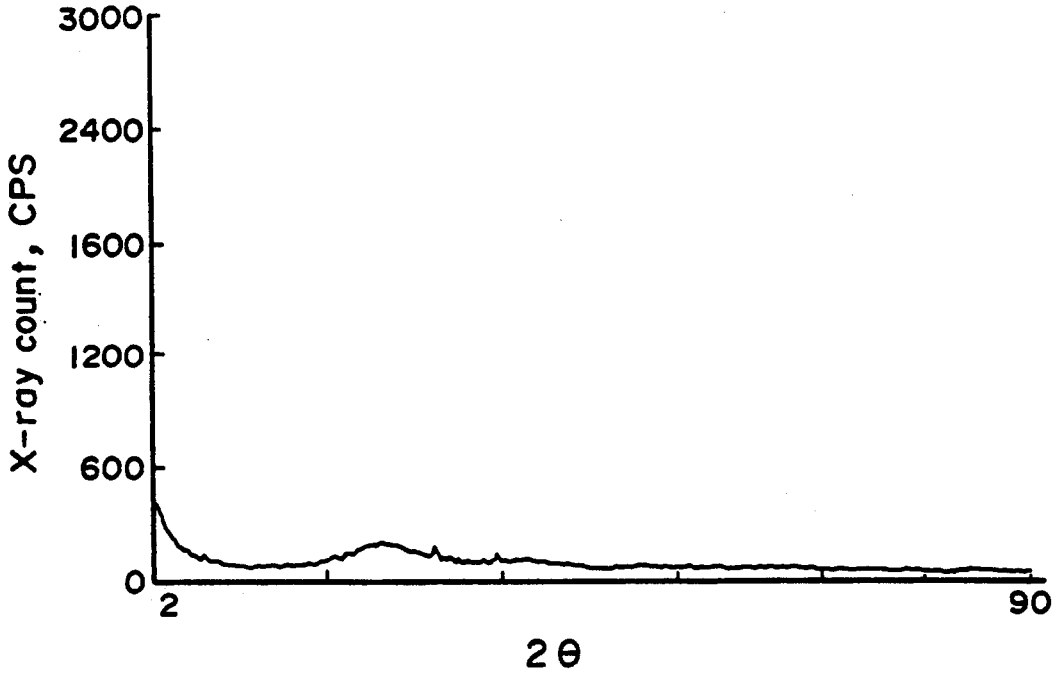
FIGS. 7 and 8 are graphs showing the results of XRD and the results of IR spectroscopy, respectively, of a product of the reaction of CsCl with $H_3BO_3$ according to the present invention.
Figure 8:
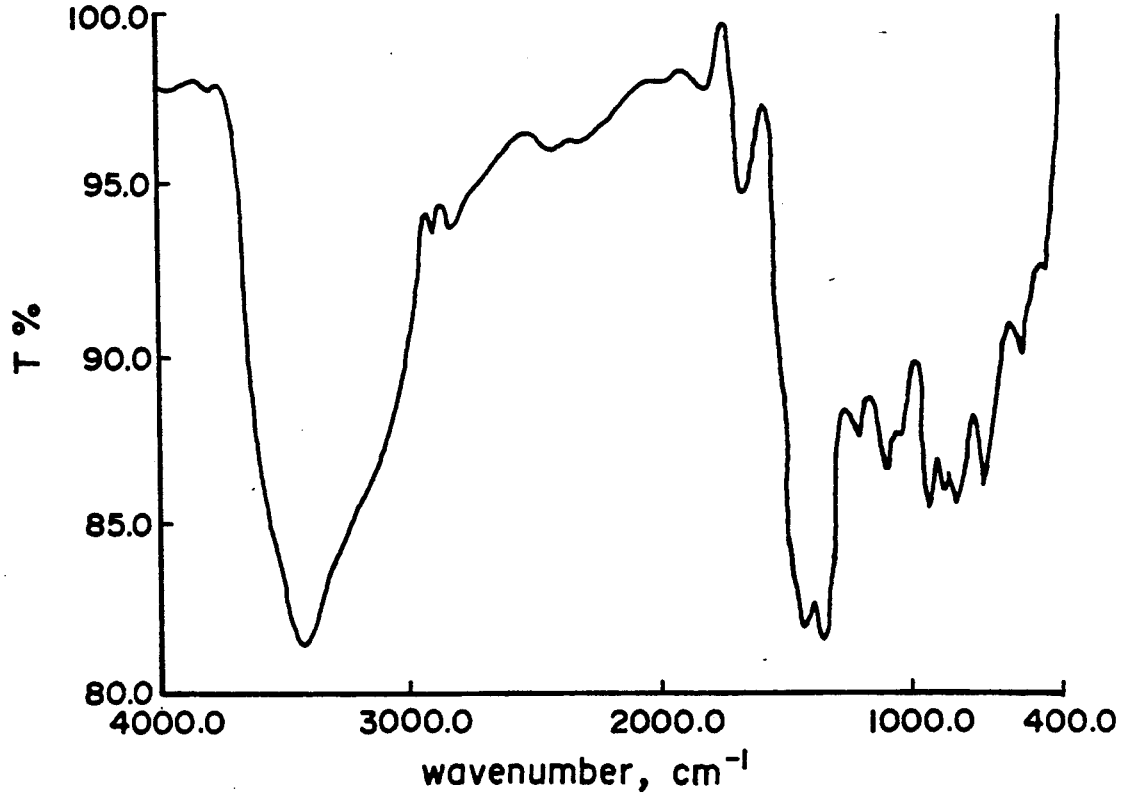

The results of XRD of this vitreous product are shown in FIG. 7, and the results of IR spectroscopy are shown in FIG. 8. From these results, this product is thought to be a glass composed mainly of $0.25Cs_2O.0.75B_2O_3$.

f. Mixture system comprising $BaCl_2$ and $H_3BO_3$

A mixture prepared by mixing $BaCl_2$ with $H_3BO_3$ in a molar ratio of 1:2 was heated. In this case, the following reactions are thought to occur:

$$3BaCl_2.2H_2O+2H_3BO_3 \rightarrow 3BaO+B_2O_3+6HCl\uparrow+6H_2O\uparrow \quad (12)$$

$$2H_3BO_3 \rightarrow B_2O_3+3H_2O\uparrow \quad (13)$$

The heating provided a white product. The degree of conversion was 97% as calculated from a change in the weight before and after the heating.

Figure 9:
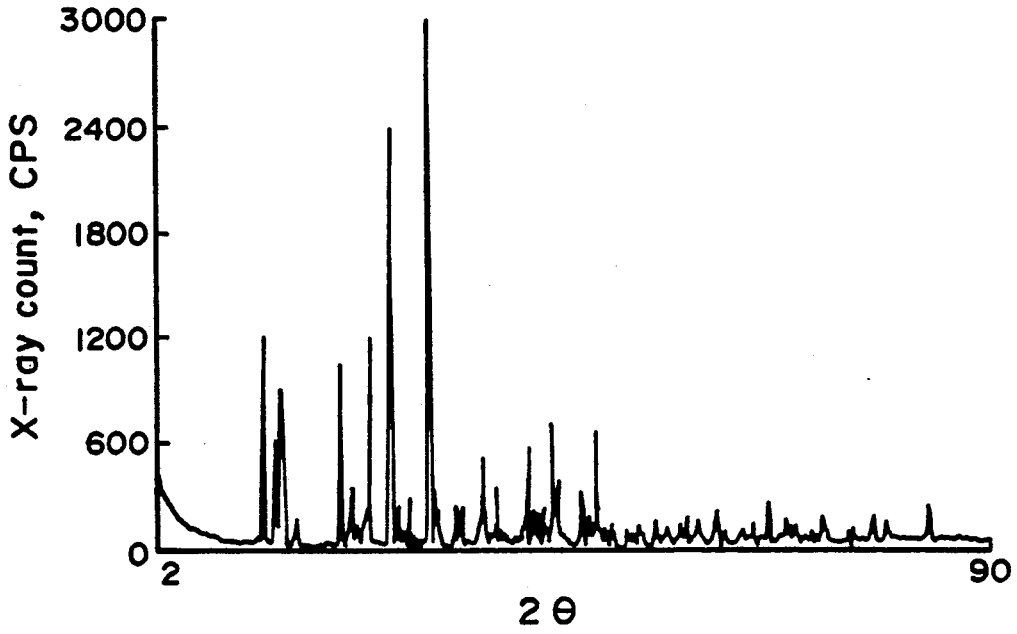
FIGS. 9 and 10 are graphs showing the results of XRD and the results of IR spectroscopy, respectively, of a product of the reaction of $BaCl_2$ with $H_3BO_3$ according to the present invention.
Figure 10:
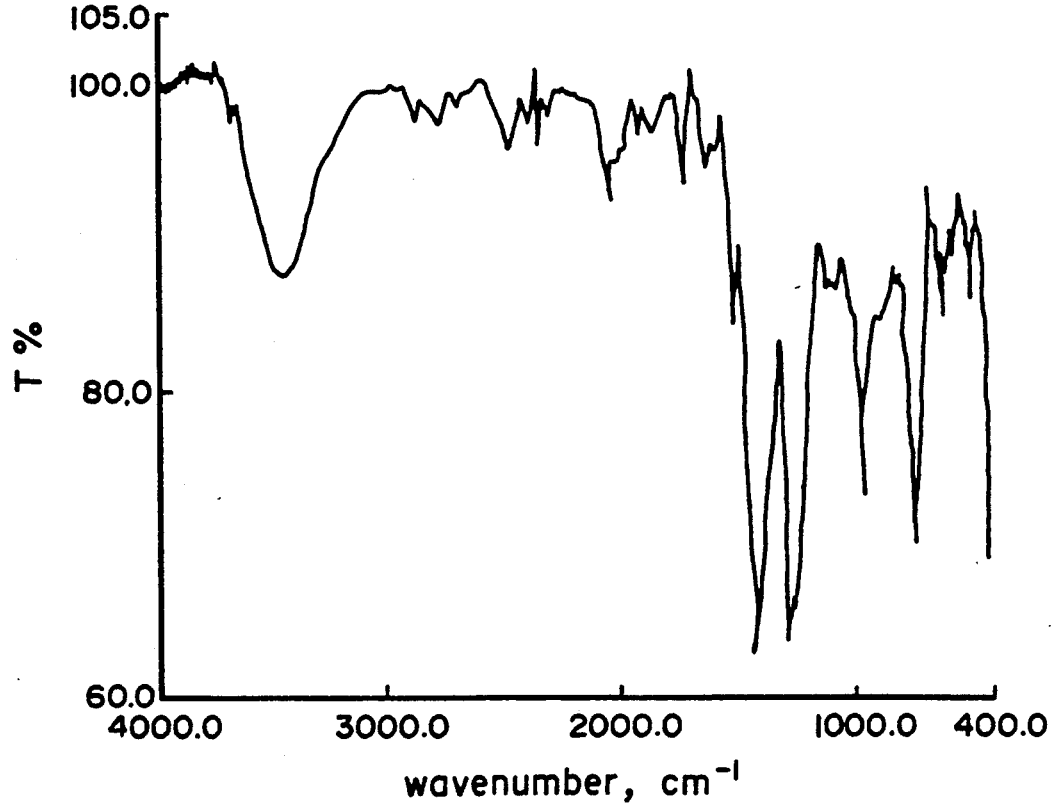

The results of XRD of this white product are shown in FIG. 9, and the results of IR spectroscopy are shown in FIG. 10. From these results, this product was identified with crystalline $BaB_2O_4$.

g. Mixture system comprising $SrCl_2$ and $H_3BO_3$

A mixture comprising $SrCl_2$ and $H_3BO_3$ in a molar ratio of 1:2 was heated. In this case, the following reactions are thought to occur:

$$3SrCl_2+2H_3BO_3 \rightarrow B_2O_3+3H_2O\uparrow \quad (15)$$

The degree of conversion was 96% as calculated from a change in the weight before and after the heating.

Figure 11:
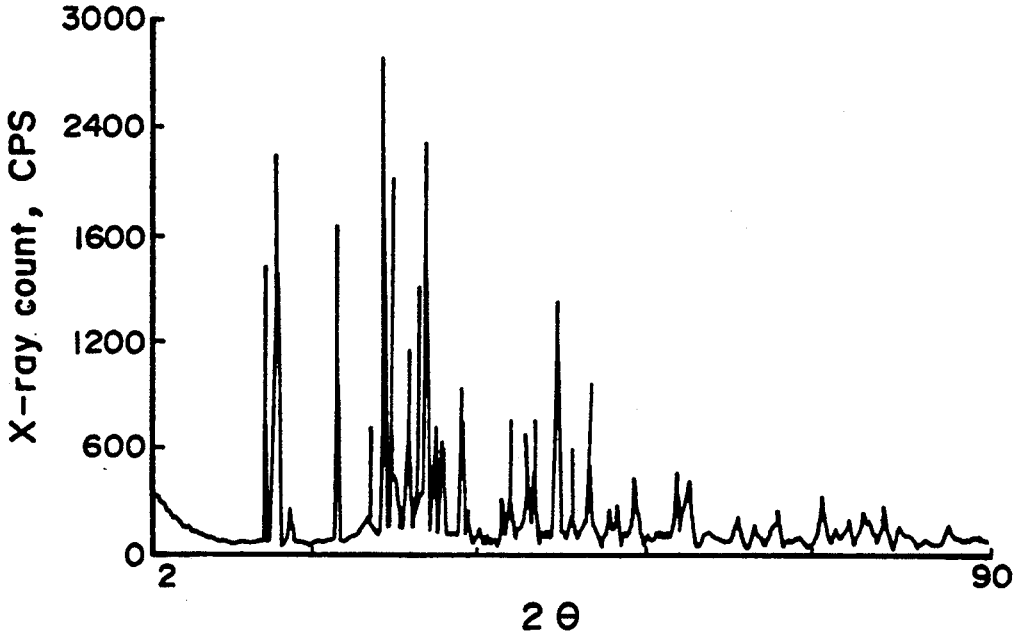
FIGS. 11 and 12 are graphs showing the results of XRD and the results of IR spectroscopy, respectively, of a product of the reaction of $SrCl_2$ with $H_3BO_3$ according to the present invention.
Figure 12:
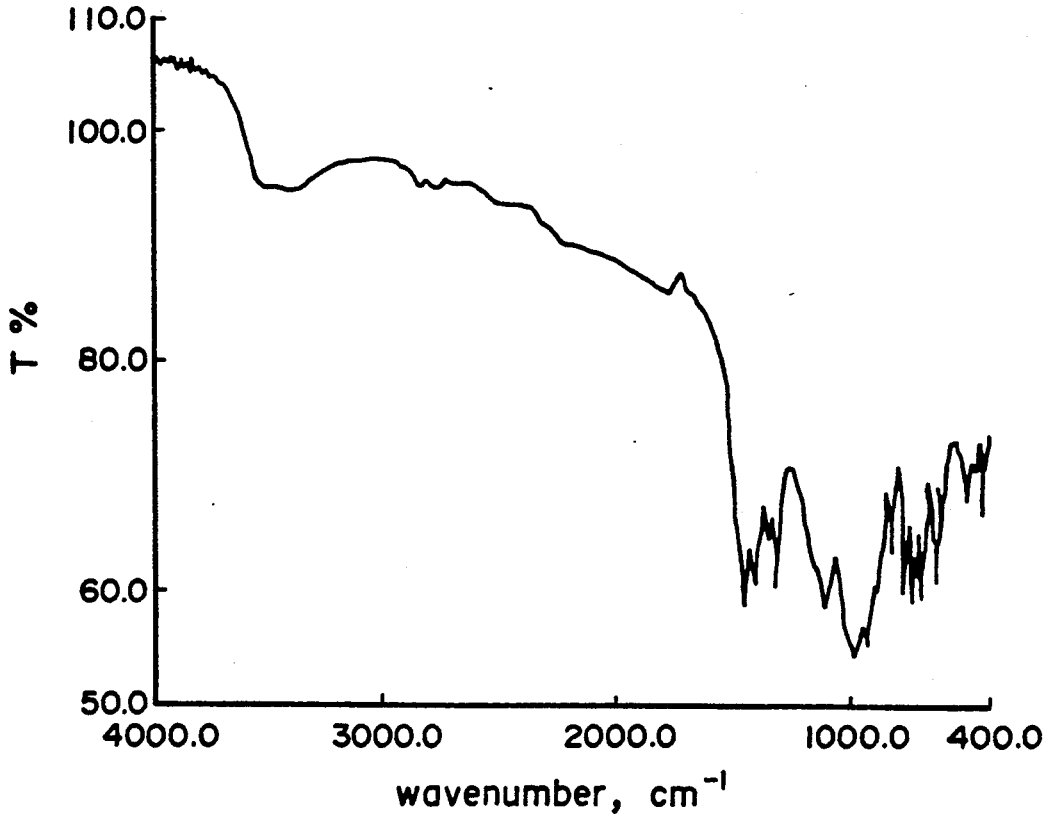

The results of XRD of this product are shown in FIG. 11, and the results of IR spectroscopy are shown in FIG. 12. From these results, this product was thought to be a crystalline substance comprising $0.33SrO.0.67B_2O_3$.

h. Mixture system comprising $CeCl_3$ and $H_3BO_3$

A mixture prepared by mixing $CeCl_3.6H_2O$ with $H_3BO_3$ in a molar ratio of $CeCl_3$ to $H_3BO_3$ of 1:3 was heated. In this case, the following reactions are thought to occur:

$$2CeCl_3.6H_2O+2H_3BO_3 \rightarrow Ce_2O_3+B_2O_3+6HCl\uparrow+6H_2O\uparrow \quad (16)$$

$$2H_3BO_3 \rightarrow B_2O_3+3H_2O\uparrow \quad (17)$$

The heating provided a white product. On the assumption that these reactions occur, the degree of conversion was calculated from a change in the weight before and after the heating and found to be 95%.

Figure 13:
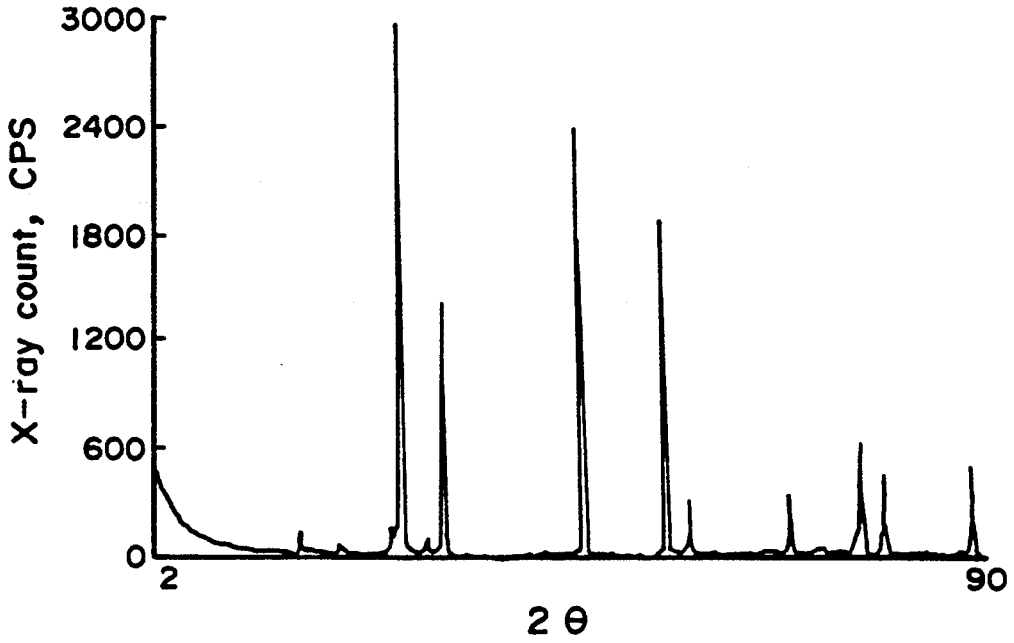
FIGS. 13 and 14 are graphs showing the results of XRD and the results of IR spectroscopy, respectively, of a product of the reaction of $CeCl_3$ with $H_3BO_3$ according to the present invention.
Figure 14:
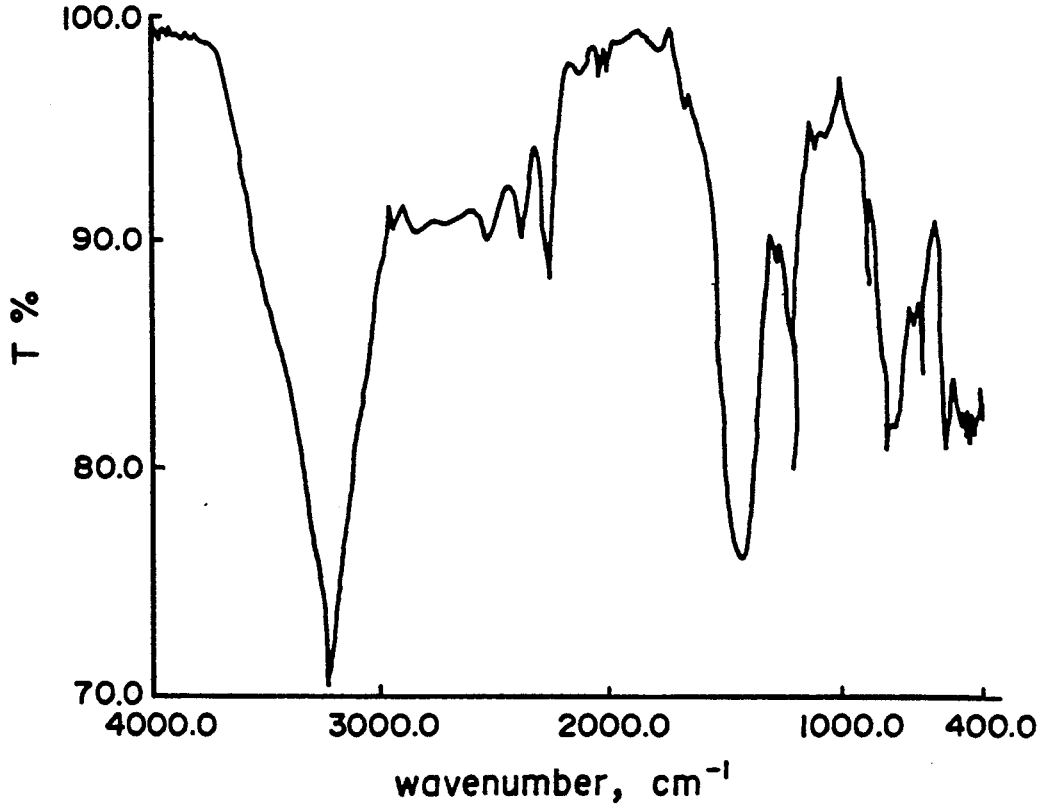

The results of XRD of this product are shown in FIG. 13, and the results of IR spectroscopy are shown in FIG. 14. From these results, this product was identified with $CeO_2$.

From the results in the above-described Experimental Example, it has been found that any of the chlorides can be converted into an oxide at a high degree of conversion. Although the amount of boric acid to be reacted was 3 times the stoichiometric amount in the above-described Experimental Example, a further improvement in the conversion can be attained when the amount of boric acid was 5 to 6 times the stoichiometric amount.

Experimental Example 2

A mixture prepared by mixing equimolar amounts of KCl, NaCl and LiCl with each other was used, and this mixture of chlorides was mixed with boric acid in an amount of 6 times the stoichiometric amount to prepare a sample mixture. Specifically, the composition of the sample mixture was adjusted so as to have the following molar ratio:

$$(KCl+NaCl+LiCl):H_3BO_3=1:2$$

This sample mixture was heated in the same manner as that of the Experimental Example 1 to give a transparent, vitreous product. The degree of conversion was determined in the same manner as that of the Example 1 and found to be 99.8%.

Figure 15:
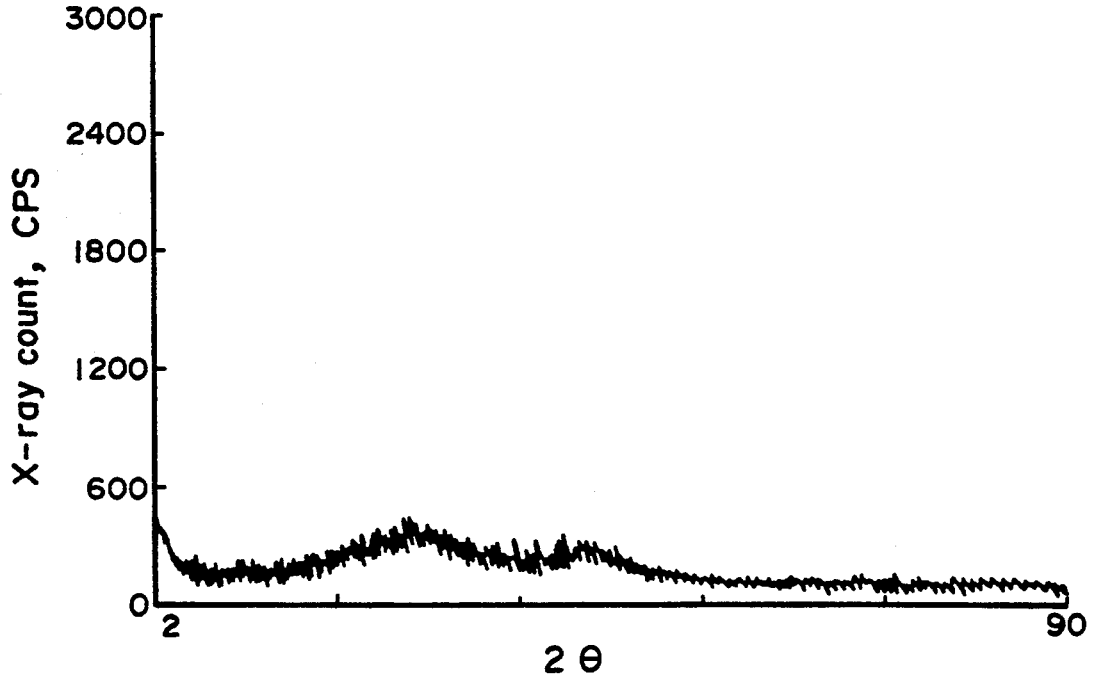
FIGS. 15 and 16 are graphs showing the results of XRD and the results of IR spectroscopy, respectively, of a product of the reaction of KCl, NaCl and LiCl with $H_3BO_3$ according to the present invention.
Figure 16:
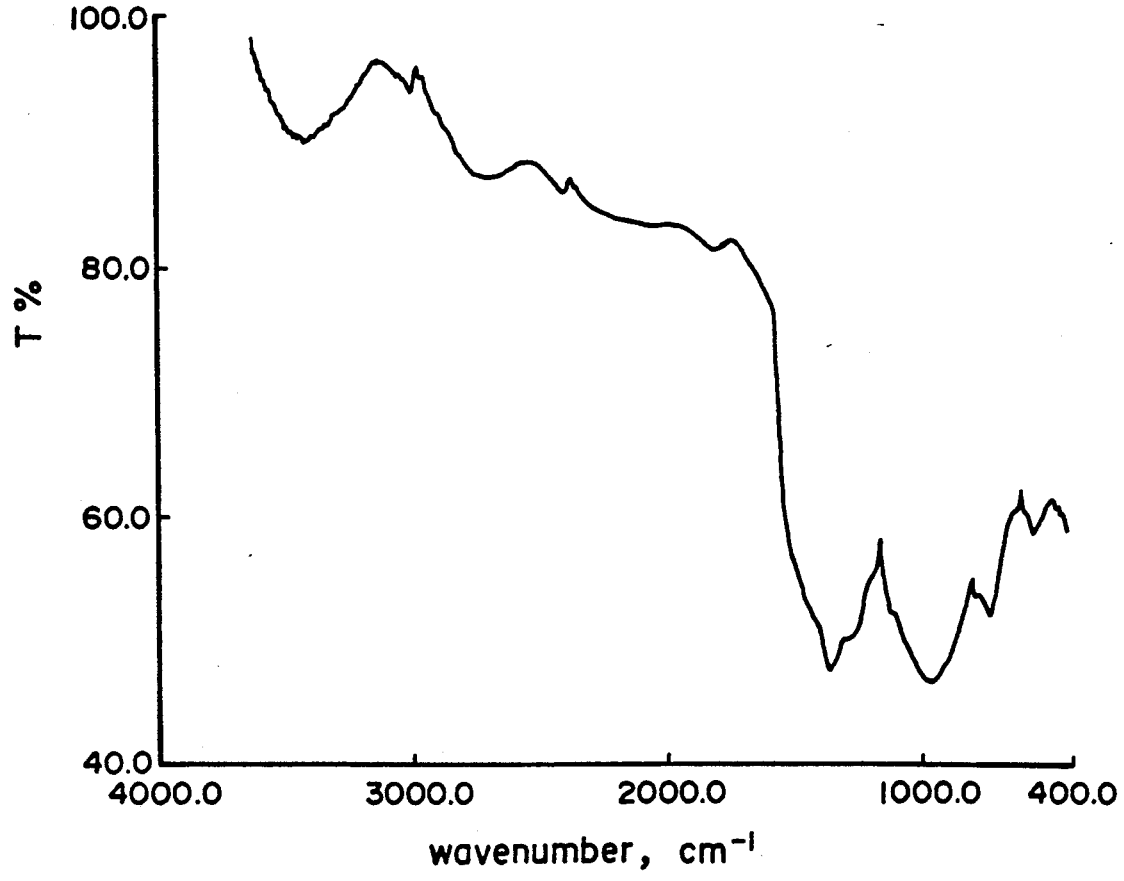

This product was subjected to XRD and IR spectroscopy in the same manner as that of the Experimental Example 1. The results of XRD of the product are shown in FIG. 15, and the results of IR spectroscopy are shown in FIG. 16. From these results, this product is thought to be a mixture of $Na_2O.2B_2O_3$, $K_2O.2b_20_3$ and $Li_2O.2B_2O_3$ glasses.

EXAMPLE 1

A spent metallic fuel having a fuel composition of U-16.2Pu-10Zr on the average in the reactor core was dry reprocessed. In the dry reprocessing, the molten salt electrolysis of a LiCl-KCl eutectic salt using molten cadmium as an anode was conducted to give a salt waste listed in Table 1.

TABLE 1

| | | Weight (kg/year) | Radioactivity (Ci/year) | Calorific value (W/year) |
|---|---|---|---|---|
| actinoid | $UCl_3$ | $6.7 \times 10$ | $3.1 \times 10^{-2}$ | $5.3 \times 10^{-4}$ |
| | $PuCl_3$ | 8.5 | $3.8 \times 10^4$ | $2.8 \times 10$ |
| | $NpCl_3$ | 5.0 | $1.7 \times 10^3$ | 4.1 |
| | $AmCl_3$ | $3.2 \times 10$ | $5.5 \times 10^4$ | $1.6 \times 10^3$ |
| | $CmCl_3$ | 2.6 | $7.0 \times 10^5$ | $4.9 \times 10^3$ |
| alkali | CsCl | $1.3 \times 10^2$ | $4.9 \times 10^6$ | $2.5 \times 10^4$ |
| | RbCl | 7.9 | $3.7 \times 10^{-1}$ | $1.7 \times 10^{-3}$ |
| | NaCl | $6.8 \times 10^2$ | 3.8 | $5.4 \times 10^{-2}$ |
| alkaline | $BaCl_2$ | $5.8 \times 10$ | $2.6 \times 10^6$ | $1.0 \times 10^4$ |
| earth | $MgCl_2$ | $6.9 \times 10^{-1}$ | $1.4 \times 10^2$ | — |
| metal | $SrCl_2$ | $2.3 \times 10$ | $1.1 \times 10^6$ | $1.5 \times 10^3$ |
| rare earth | $LaCl_3$ | $5.5 \times 10$ | $9.7 \times 10^{-2}$ | $1.6 \times 10^{-3}$ |
| | $PrCl_3$ | $5.0 \times 10$ | $9.3 \times 10^6$ | $6.8 \times 10^4$ |
| | $CeCl_3$ | $1.0 \times 10^2$ | $9.2 \times 10^6$ | $6.1 \times 10^3$ |
| | $NdCl_3$ | $1.6 \times 10^2$ | $1.7 \times 10^{-3}$ | $4.0 \times 10^{-6}$ |
| | $SmCl_3$ | $4.6 \times 10$ | $9.3 \times 10^4$ | $1.1 \times 10$ |
| | $PmCl_3$ | 7.6 | $4.1 \times 10^6$ | $1.6 \times 10^3$ |
| | $YCl_3$ | $1.5 \times 10$ | $1.2 \times 10^6$ | $6.4 \times 10^3$ |
| | $TbCl_3$ | $3.9 \times 10^{-1}$ | $3.7 \times 10^3$ | $3.1 \times 10$ |
| | $GdCl_3$ | 5.1 | $1.4 \times 10^3$ | 1.2 |
| | $EuCl_3$ | 5.8 | $5.3 \times 10^5$ | $1.7 \times 10^3$ |
| others | Te | $1.8 \times 10$ | $2.9 \times 10^5$ | $2.6 \times 10^2$ |
| | I | $1.0 \times 10$ | 1.3 | $5.9 \times 10^{-4}$ |
| bath salt | LiCl—KCl | $3.6 \times 10^3$ | — | — |
| in Total | | $5.1 \times 10^3$ | $3.4 \times 10^7$ | $1.2 \times 10^5$ |

1.0 Kg of the pulverized salt waste as shown in Table 1 was mixed with 2.2 Kg of boric acid, and the mixture was heated from room temperature to 1000° C. over a period of 2 hours and heat-treated at that temperature for one hour to give a mixture of oxides.

Predetermined amounts of $SiO_2$, $B_2O_3$, $Al_2O_3$, $Li_2O$, $Na_2O$, $K_2O$, CaO and ZnO were added thereto, the resulting mixture was melted, and the molten mixture is cooled to form a vitrification product. At that time, $SiO_2$, $B_2O_3$ and $Al_2O_3$ were added so that the contents of $SiO_2$, $B_2O_3$ and $Al_2O_3$ in the vitrification product were 43% by weight, 14% by weight and 35% by weight, respectively. The weight ratio of the mixture of oxides to the additive was 1:4. The FP content in the vitrification product was about 20% by weight.

According to the present invention as described above, the salt waste generated in the dry reprocessing of the metallic fuel can be relatively easily converted into an easily vitrifiable oxide, which enables the salt waste to be disposed of as a vitrification product stable for a long period of time.

What is claimed is:

1. A process for treating a salt waste composed mainly of chlorides generated from molten salt electrolytic purification in dry reprocessing of a spent metallic nuclear fuel, which process comprising reacting said salt waste with boric acid to convert the chlorides in said salt waste to oxides.

2. The process according to claim 1, which further comprises adding a vitrifying additive to the resulting oxides of the salt waste, heat-melting the mixture to form a molten mixture, and cooling the molten mixture to obtain a vitrification product.

3. The process according to claim 1, wherein the reaction of the salt waste with boric acid is carried out at about 800° to 1000° C.

4. The process according to claim 1, wherein the amount of boric acid to be reacted is 3 to 6 times the stoichiometric amount.

5. The process according to claim 2, wherein the reaction of the salt waste with boric acid is carried out at about 800° to 1000° C.

6. The process according to claim 2, wherein the amount of boric acid to be reacted is 3 to 6 times the stoichiometric amount.

7. The process according to claim 3, wherein the amount of boric acid to be reacted is 3 to 6 times the stoichiometric amount.

* * * * *